US006332379B1

(12) United States Patent
Klomp

(10) Patent No.: US 6,332,379 B1
(45) Date of Patent: Dec. 25, 2001

(54) RATCHET WRENCH ASSEMBLY WITH GRIPPING SURFACE

(76) Inventor: Terry Klomp, 1612 Sylvanct, Flossmoor, IL (US) 60422

( * ) Notice: Subject to any disclaimer, the term of this patent is extended or adjusted under 35 U.S.C. 154(b) by 243 days.

(21) Appl. No.: 08/978,625

(22) Filed: Nov. 25, 1997

(51) Int. Cl.[7] ..... B25B 13/46
(52) U.S. Cl. ..... 81/60; 81/177.2; 81/121.1
(58) Field of Search ..... 81/60–63.2, 121.1, 81/124.3, 177.2

(56) References Cited

U.S. PATENT DOCUMENTS 3,575,069 * 4/1971 White ..... 81/62 X
4,004,476 * 1/1977 DeVrou ..... 81/177.2
4,056,020 * 11/1977 Coviello ..... 81/177.2
5,606,897 * 3/1997 Quinn ..... 81/121.1 X

* cited by examiner

*Primary Examiner*—James G. Smith

(57) ABSTRACT

A ratchet wrench assembly with gripping surface is provided including a ratchet wrench having a plurality of extents each with an outer surface. Every outer surface of the ratchet wrench has a gripping surface formed along its entirety.

1 Claim, 2 Drawing Sheets

RATCHET WRENCH ASSEMBLY WITH GRIPPING SURFACE

BACKGROUND OF THE INVENTION

1. Field of the Invention

The present invention relates to a ratchet wrench assembly with gripping surface and more particularly pertains to preventing slippage during any type of handling of a ratchet wrench.

2. Description of the Prior Art

The use of gripping surfaces for ratchet wrench handles is known in the prior art. More specifically, gripping surfaces for ratchet wrench handles heretofore devised and utilized for the purpose of preventing slippage during use of a ratchet wrench are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 4,942,791; 5,329,834; U.S. Patent Des. 360,123; U.S. Pat. Nos. 4,030,150; 5,280,735; and 5,343,776.

In this respect, the ratchet wrench assembly with gripping surface according to the present invention substantially departs from the conventional concepts and designs of the prior art, and in so doing provides an apparatus primarily developed for the purpose of preventing slippage during any type of handling of a ratchet wrench.

Therefore, it can be appreciated that there exists a continuing need for a new and improved ratchet wrench assembly with gripping surface which can be used for preventing slippage during any type of handling of a ratchet wrench. In this regard, the present invention substantially fulfills this need.

SUMMARY OF THE INVENTION

In view of the foregoing disadvantages inherent in the known types of gripping surfaces for ratchet wrench handles now present in the prior art, the present invention provides an improved ratchet wrench assembly with gripping surface. As such, the general purpose of the present invention, which will be described subsequently in greater detail, is to provide a new and improved ratchet wrench assembly with gripping surface which has all the advantages of the prior art and none of the disadvantages.

To attain this, the present invention essentially comprises a ratchet wrench with a first end extent having a cylindrical configuration, a first diameter and an outer surface. An intermediate extent is integrally coupled to the first end extent in coaxial alignment therewith. The intermediate extent is equipped with a cylindrical configuration having a second diameter less than the first diameter and an outer surface. Finally, a second end extent is provided having a disk-shaped head with a top circular face, a bottom circular face, and a periphery formed therebetween with an outer surface. As shown in FIG. 1, the periphery of the head is integrally coupled to the intermediate extent. It should be noted that the head has a cubical rotator rotatably coupled to the top face thereof. With reference to FIG. 3, there is shown a ratchet wrench extender including a first end extent with a cylindrical configuration having a first diameter and an outer surface. The first end extent has a cubical male connector integrally coupled thereto for reasons that will become apparent hereinafter. An intermediate extent is integrally coupled to the first end extent in coaxial alignment therewith. The intermediate extent has a cylindrical configuration having a second diameter less than the first diameter and an outer surface. A second end extent also is equipped with a cylindrical configuration having the first diameter and an outer surface. A cubical female receptor is formed in the second end extent for releasably receiving the cubical rotator. FIG. 2 shows a cylindrical socket having a first circular end face with a cubical female receptor formed therein for releasably receiving the male cubical rotator and the male connector. The socket further has a second circular end face with a hexagonal female receptor. A periphery is formed between the end faces with an outer surface. It is imperative that every outer surface of the ratchet wrench, ratchet wrench extender, and the socket have a plurality of intersecting, continuous and linear grooves formed therein. Such grooves are formed in the outer surfaces over an entirety thereof. As shown in FIG. 4, each groove has a triangular cross-section and a common predetermined depth. The grooves are configured to define a multiplicity of uniform identical parallelograms to preclude slippage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ratchet wrench assembly with gripping surface which has all the advantages of the prior art gripping surfaces for ratchet wrench handles and none of the disadvantages.

It is another object of the present invention to provide a new and improved ratchet wrench assembly with gripping surface which may be easily and efficiently manufactured and marketed.

It is a further object of the present invention to provide a new and improved ratchet wrench assembly with gripping surface which is of a durable and reliable construction.

An even further object of the present invention is to provide a new and improved ratchet wrench assembly with gripping surface which is susceptible of a low cost of manufacture with regard to both materials and labor, and which accordingly is then susceptible of low prices of sale to the consuming public, thereby making such ratchet wrench assembly with gripping surface economically available to the buying public.

Still yet another object of the present invention is to provide a new and improved ratchet wrench assembly with gripping surface which provides in the apparatuses and methods of the prior art some of the advantages thereof, while simultaneously overcoming some of the disadvantages normally associated therewith.

Still another object of the present invention is to prevent slippage during any type of handling of a ratchet wrench.

Lastly, it is an object of the present invention to provide a new and improved ratchet wrench assembly with gripping surface including a ratchet wrench having a plurality of extents each with an outer surface. Every outer surface of the ratchet wrench has a gripping surface formed along its entirety.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
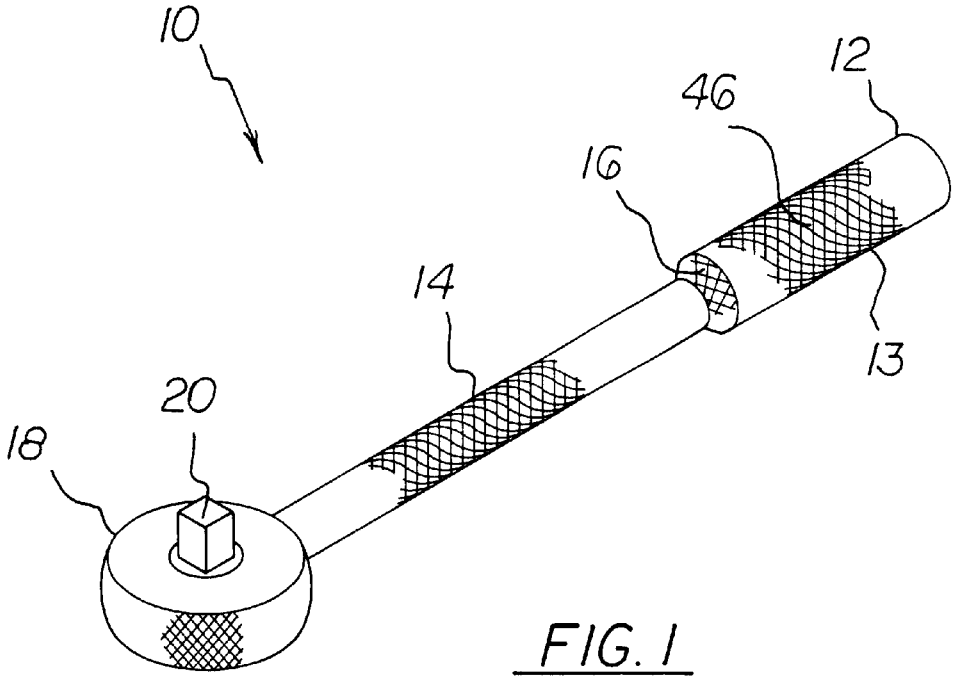
FIG. 1 is a perspective illustration of the preferred embodiment of the ratchet wrench assembly with gripping surface constructed in accordance with the principles of the present invention.

With reference now to the drawings, and in particular to FIG. 1 thereof, a new and improved ratchet wrench assembly with gripping surface embodying the principles and concepts of the present invention and generally designated by the reference numeral 10 will be described.

The present invention, the new and improved ratchet wrench assembly with gripping surface, is comprised of a plurality of components. Such components in their broadest context include a ratchet wrench, ratchet wrench extender, socket, and a plurality of intersecting grooves. Such components are individually configured and correlated with respect to each other so as to attain the desired objective.

More specifically, it will be noted that the system 10 of the present invention includes a ratchet wrench 12 with a first end extent 13 having a cylindrical configuration, a first diameter and an outer surface. An intermediate extent 14 is integrally coupled to the first end extent in coaxial alignment therewith. The intermediate extent is equipped with a cylindrical configuration having a second diameter ½ that of the first diameter and an outer surface. An annular bevelled portion 16 is formed between the intermediate extent and the first end extent. The annular bevelled portion has an outer surface with a frusto-conical configuration. Finally, a second end extent 18 is provided having a disk-shaped head with a top circular face, a bottom circular face, and a periphery formed therebetween with an outer surface. As shown in FIG. 1, the periphery of the head is integrally coupled to the intermediate extent. It should be noted that the head has a cubical rotator 20 rotatably coupled to the top face thereof.

Figure 3:
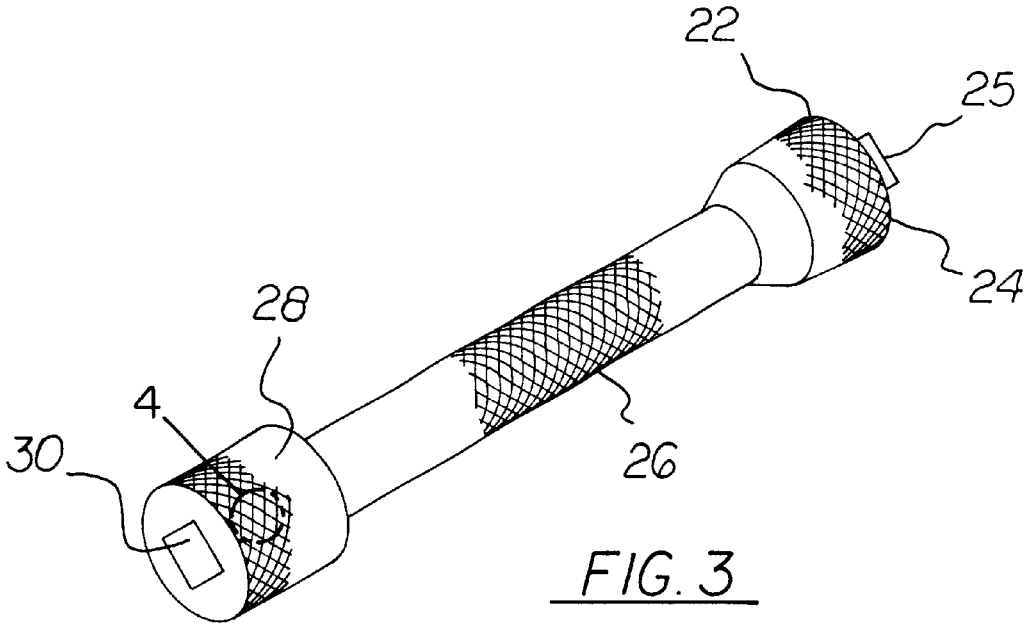
FIG. 3 is a perspective view of the ratchet wrench extender of the present invention.

With reference to FIG. 3, there is shown a ratchet wrench extender 22 including a first end extent 24 with a cylindrical configuration having a first diameter and an outer surface. The first end extent has a cubical male connector 25 integrally coupled thereto for reasons that will become apparent hereinafter. An intermediate extent 26 is integrally coupled to the first end extent in coaxial alignment therewith. The intermediate extent has a cylindrical configuration having a second diameter less than the first diameter and an outer surface. A second end extent 28 also is equipped with a cylindrical configuration having the first diameter and an outer surface. A cubical female receptor 30 is formed in the second end extent for releasably receiving the cubical rotator. In the preferred embodiment, the first diameter is preferably twice that of the second diameter.

Figure 2:
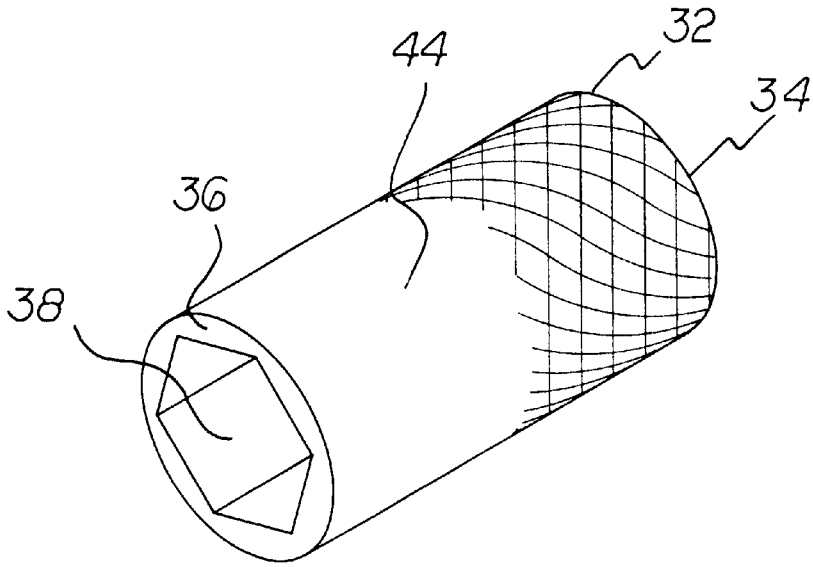
FIG. 2 is a perspective view of the socket of the present invention.

FIG. 2 shows a cylindrical socket 32 having a first circular end face 34 with a cubical female receptor formed therein for releasably receiving the male cubical rotator and the male connector. The socket further has a second circular end face 36 with a hexagonal female receptor 38. A periphery 44 is formed between the end faces to define an outer surface. Ideally, indicia representative of a size of the socket is imprinted in the outer surface thereof.

Figure 4:
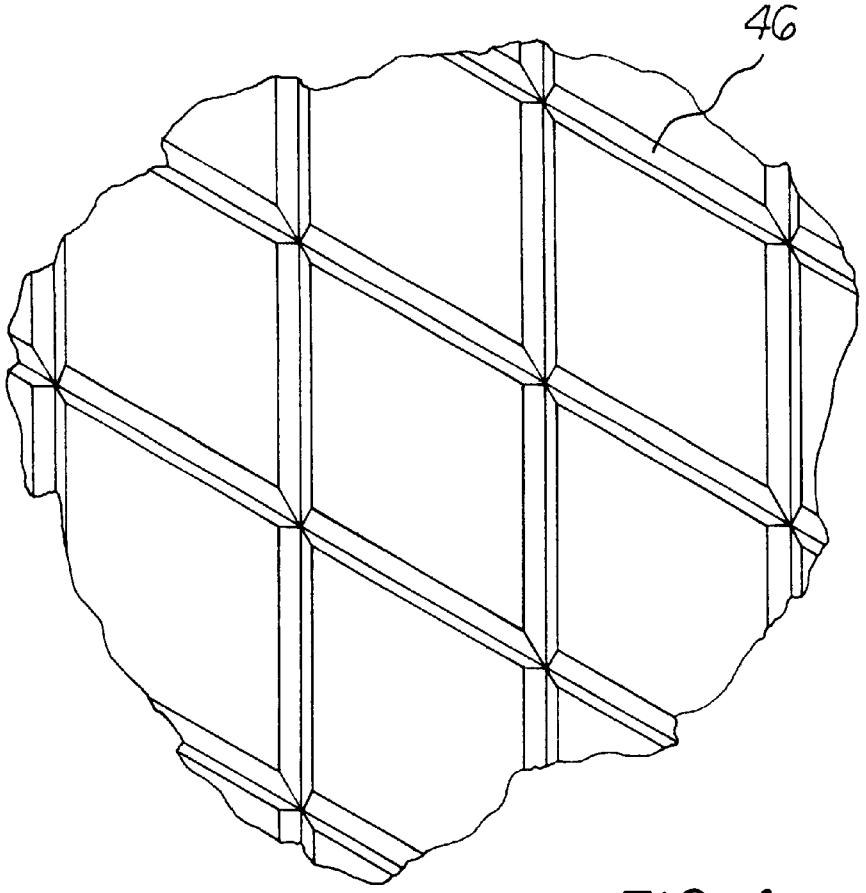
FIG. 4 is a close-up perspective view of the grooves of the present invention.

It is imperative that every outer surface of the ratchet wrench, ratchet wrench extender, and the socket have a plurality of intersecting, continuous and linear grooves 46 formed therein. Such grooves are formed in the outer surfaces over an entirety thereof. As shown in FIG. 4, each groove has a triangular cross-section and a common predetermined depth. The grooves are configured to define a multiplicity of uniform identical parallelograms to preclude slippage. Such parallelograms resemble diamonds, as shown in FIG. 4. The outer surfaces are further colored with a glow in the dark or fluorescent paint for the purpose of allowing the present invention to be seen and grasped in areas without sufficient ambient light such as in garages and beneath vehicles.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ratchet wrench assembly with gripping surface comprising in combination:

a ratchet wrench including a first end extent with a cylindrical configuration having a first diameter and an outer surface, an intermediate extent integrally coupled to the first end extent in coaxial alignment therewith with a cylindrical configuration having a second diameter less than the first diameter and an outer surface, and a second end extent having a disk-shaped head with a top circular face, a bottom circular face, and a periphery formed therebetween with an outer surface, the periphery of the head being integrally coupled to the intermediate extent, wherein the head has a cubical rotator rotatably coupled to the top face thereof;

a ratchet wrench extender including a first end extent with a cylindrical configuration having a first diameter and an outer surface with the first end extent having a cubical male connector integrally coupled thereto, an intermediate extent integrally coupled to the first end extent in coaxial alignment therewith with a cylindrical configuration having a second diameter less than the first diameter and an outer surface, a second end extent with a cylindrical configuration having the first diameter and an outer surface with the second end extent having a cubical female receptor formed therein for releasably receiving the cubical rotator;

at least one cylindrical socket having a first circular end face with a cubical female receptor formed therein for releasably receiving the male cubical rotator and the male connector, a second circular end face with a hexagonal female receptor, and a periphery formed therebetween with an outer surface;

whereby every outer surface of the ratchet wrench including the first end extent and intermediate extent and second end extent, ratchet wrench extender, and the at least one socket having a plurality of intersecting, continuous and linear grooves of an essentially common configuration formed therein along an entirety thereof, each groove having a triangular cross-section and a common predetermined depth, the grooves configured to define a multiplicity of uniform identical parallelograms for precluding slippage.

* * * * *